US005375946A

United States Patent [19]

Locotos

[11] Patent Number: 5,375,946

[45] Date of Patent: Dec. 27, 1994

[54] MINE ROOF SUPPORT APPARATUS AND METHOD

[75] Inventor: Frank M. Locotos, Bridgeville, Pa.

[73] Assignee: F. M. Locotos Equipment & Design Co., McMurray, Pa.

[21] Appl. No.: 832,008

[22] Filed: Feb. 6, 1992

[51] Int. Cl.[5] ..... E21D 20/02

[52] U.S. Cl. ..... 405/259.4; 405/259.1; 405/259.6

[58] Field of Search ..... 405/259.1, 259.4, 259.5, 405/259.6, 262, 288

[56] References Cited

U.S. PATENT DOCUMENTS

| | | | |
|---|---|---|---|
| 3,077,809 | 2/1963 | Harding et al. | 405/302.2 X |
| 3,509,726 | 5/1970 | White | 405/259.1 X |
| 4,265,571 | 5/1981 | Scott | 405/288 X |
| 4,634,318 | 1/1987 | Koumal | 405/288 X |
| 4,704,053 | 11/1987 | Hipkins et al. | 405/259.6 |
| 4,798,501 | 1/1989 | Spies | 405/259.5 |

*Primary Examiner*—David H. Corbin
*Attorney, Agent, or Firm*—Ansel M. Schwartz

[57] ABSTRACT

The present invention pertains to a mining support for supporting rock within a mine. The support includes a cable and a threaded shaft fixedly attached to a first end of the cable. There is also an expansion anchor threadingly engaged about the threaded shaft for anchoring against the rock within a bore hole and means for bearing against the rock at the opening of the bore hole. The bearing means preferably includes a second collar having a threaded portion on which a hex nut is mounted and a contact plate for bearing against the rock. Preferably, there is a first collar for fixedly attaching the cable to the threaded shaft. Alternatively, the threaded shaft has a cavity for engaging with the cable. In a preferred embodiment, the mining support includes means for mixing resin in a resin cartridge. The mixing means is positioned about a portion of the cable. The mixing means preferably includes a helical wire strand that wraps about a portion of the cable. A bending restrictor can be disposed about the cable such that at least a portion of the cable is prevented from bending as it is inserted into the bore hole. The present invention is also a method of supporting rock within a mine. There is the first step of drilling a bore hole into the rock. Next, there is the step of placing a first end of a cable into the bore hole. Then, there is the step of turning the cable such that an expansion anchor on the cable expands to anchor the cable within the bore hole. Preferably, after the drilling step, there is the step of inserting a resin cartridge having resin disposed within into the bore hole.

12 Claims, 1 Drawing Sheet

MINE ROOF SUPPORT APPARATUS AND METHOD

FIELD OF THE INVENTION

The present invention is related to mine roof supports. More specifically, the present invention is related to a mine roof support comprising a cable having an expansion anchor.

BACKGROUND OF THE INVENTION

It is well established practice in underground mining work, such as coal mining, tunnel excavation, or the like, to reinforce the roof of the mine to prevent its collapse. There are various types of reinforcement apparatus, the most common are of the mining bolt type. These mining bolts can consist of various designs:

1. Mechanical bolts which have a smooth round shaft—a forged head and a bearing plate on one end, and an expansion anchor at the other. (Tensioned Bolt)

2. Fully grouted resin bolts which consist of a reinforcing bar with a forged head and bearing plate on one end. The remainder of the reinforcing bar is left as is. These bolts are used with polyester resin cartridges to grout around the bar and fill the annulus between the bore hole and the reinforcing bar. (Untensioned Bolt)

3. Partially anchored tensioned bolt:

A. A partially anchored (polyester resin) reinforcing bar with a frangible delay nut of various design at the bottom end plus a bearing plate. (Tensioned Bolt) referred to as a "Tension Rebar" Bolt.

B. A partially anchored (polyester resin) reinforcing bar that is threaded at its bottom portion and connected to a smooth bolt on the bottom plus a bearing plate. The reinforcing bar is grouted in polyester resin. The coupling that joins the rebar to the smooth bolt on the bottom has a delay mechanism to permit the resin to be mixed and subsequently allow take up in the coupling after the resin becomes hard. A typical bolt of this design is U.S. Pat. No. 4,477,209 entitled Combo Anchor®. (Tensioned Bolt)

C. A partially grouted smooth bolt that features a nut on the threaded top end to which is attached a mixing wire to mix the resin. The bottom end has a forged head, dual thrust washers, and a bearing plate. This is a tensioned bolt called the "Fastorq Bolt" patented by Dupont.

4. A grouping of bolts using either a headed reinforcing bar or a headed smooth bar with a bearing plate. At the top end is a mechanical anchor that is reinforced with polyester resin. (Tensioned Bolt) A typical bolt of this design is U.S. Pat. No. 4,655,645 entitled Spiral Bolt®.

5. A smooth headed bolt with a buttress deformation at the top end which screws into a compressible plastic formable material and a bearing plate at the bottom. A polyester resin cartridge can also be used to reinforce this anchorage with the plastic tube. (Tension Bolt) Patent No. 4,659,295 called DYNA ROK Anchors.

6. A long tube of high strength steel, with a slot along its entire length. One end is tapered for insertion into a drilled hole in the roof of the mine. The other end has a welded ring flange to retain a roof plate. This bolt is driven into the hole. (Untensioned Bolt) named Split Set®.

7. A bolt that is manufactured from a steel tube. The tube has been mechanically reshaped to an outer diameter that is smaller. Bushings are pressed onto the ends, which are sealed through welding. The lower bushing is flanged to hold a bearing plate in place. A hole is drilled through the lower bushing and the wall of the tube to allow water to be injected into the bolt. During installation, the high pressure water causes the bolt to expand and forms it to irregularities in the drill hole. After installation, the water pressure is released. (untensioned) Bolt called Swellex®, manufactured by Atlas Copco Co.

8. A threaded bolt which is screwed into set resin to attain a tensioned system such as the Clarich roof bolt.

9. A bolt which is driven into the roof of a mine, requiring no bore hole, similar to driving a nail into wood. This is called the Pin-Set Bolt®, Patent #3,643,542; date of issue: Feb. 22, 1972. (Untensioned Bolt).

10. A screw bolt which has a pointed threaded end portion, which, after insertion into a bore hole, screws directly into the rock at the top of the bore hole. The screw bolt is manufactured by F. M. Locotos Equipment & Design Co. and is described in U.S. patent application Ser. No. 07/771,523, allowed, but not yet issued.

To further support the roof, it is advantageous to connect steel cable to the mining bolts to support the rock between the bolting sites. In the past, numerous types of cabling systems have been proposed. A company called Ground Control Ltd., located in Canada, markets a cable bolting system that consists of a cable which is positioned into a bore hole. Bonding material is then pumped in under pressure around the cable to secure it to the rock. This cabling system suffers several drawbacks. First, the bonding material must be pumped externally in a separate step after the cable is within the bore hole. Second, the bonding material must also completely fill the bore hole in order to ensure proper contact between the rock and the cable.

Another design for a cabling system is manufactured by Ingersoll-Rand Co., Inc. and is called the Scott Cable Sling System. The apparatus consists of a cable to which is permanently attached to a stiff drive member. The cable and drive member are forced into a bore hole containing a cementatios grout. Unfortunately, after installation is complete, the drive members hang below the bore hole thereby decreasing roof clearance. Further, two drive members must be wasted each time a cable is installed.

A further design for a cable-type mining support is made by Arnall, Inc. Arnall manufactures a stranded cable a length of which has an open-weave arrangement. (i.e. the strands are not tightly wound). This allows a bonding agent of cementatios grout, which is pumped into a bore hole, to penetrate into and integrate with the cable.

The present invention discloses a cable type mining support which is faster to install than previous cabling systems known in the prior art.

SUMMARY OF THE INVENTION

The present invention is a mining support for supporting rock within a mine. The support includes a cable and a threaded shaft fixedly attached to a first end of the cable. There is also an expansion anchor threadingly engaged about the threaded shaft for anchoring against the rock within a bore hole and means for bearing against the rock at the opening of the bore hole. The bearing means is attached to the second end of the cable. Preferably, the bearing means includes a second collar having a threaded portion upon which a hex nut is mounted and a contact plate for bearing against the rock. Preferably, there is a first collar for fixedly attaching the cable to the threaded shaft.

In a preferred embodiment, the mining support includes a resin cartridge and means for mixing resin in the resin cartridge as the first end of the cable is inserted into the bore hole. The mixing means is positioned about the cable. The mixing means preferably includes a helical wire strand that wraps about the cable. A bending restrictor can be disposed about the cable such that at least a portion of the cable is prevented from bending as it is inserted into the bore hole. The first and second collars are swaged onto the cable.

The present invention is also a method of supporting rock within a mine. There is the first step of drilling a bore hole into the rock. Next, there is the step of placing a first end of a cable into the bore hole. Then, there is the step of inserting the cable into the bore hole. Next, there is the step of turning the cable such that an expansion anchor on the cable expands to anchor the cable within the bore hole. Preferably, after the drilling step, there is the step of inserting a resin cartridge having resin disposed within into the bore hole. The inserting step preferably then includes the step of puncturing the resin cartridge with the first end of the cable.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
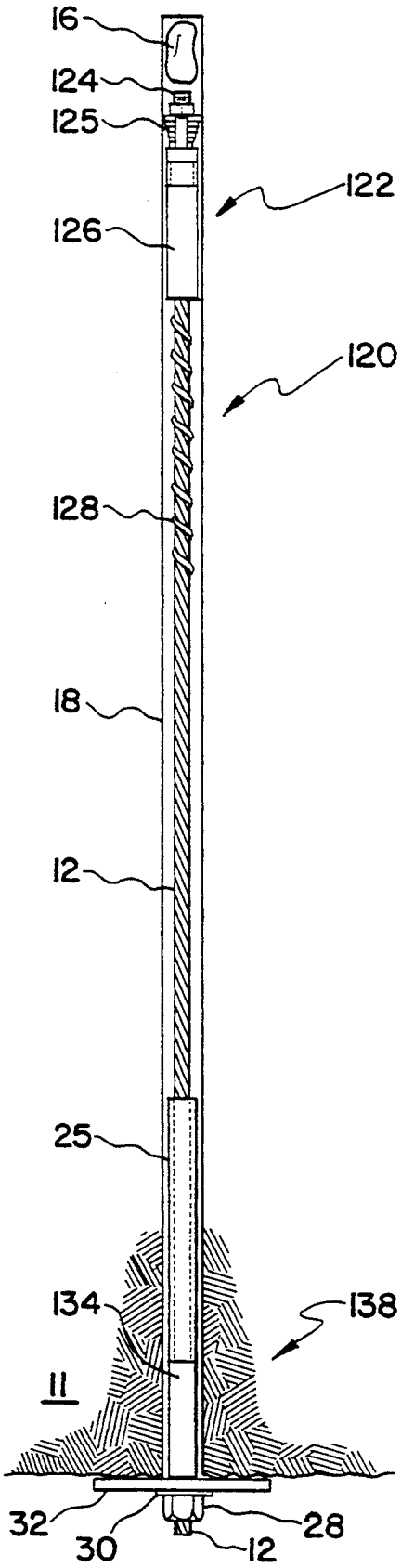
FIG. 1 is a schematic representation showing the mining support with an expansion anchor.
Figure 2:
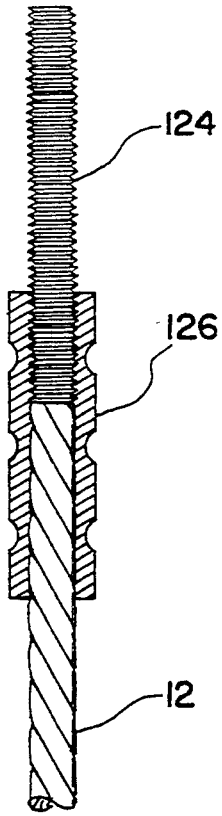
FIG. 2 is a schematic representation showing the first collar.
Figure 3:
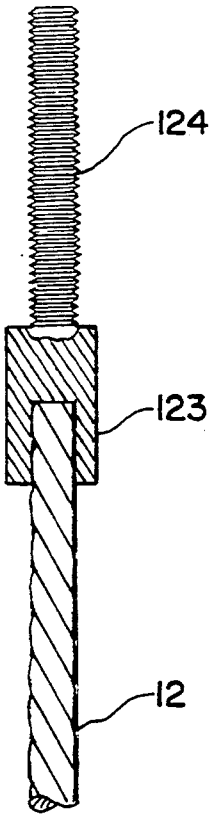
FIG. 3 is a schematic representation showing the threaded shaft having a cavity.

Referring now to the drawings wherein like reference numerals refer to similar or identical parts throughout the several views, and more specifically to FIG. 1 thereof, there is shown a mining support 120 for supporting rock 11 within a mine. The mining support 120 includes a cable 12 having a first end 122 on which a threaded shaft 124 is fixedly attached, preferably, as shown in FIG. 2, with a first collar 126 which is swaged onto the cable 12 and the threaded shaft 124. Alternatively, as shown in FIG. 3, the threaded shaft 124 can have a cavity 123 for engaging with the cable 12. The apparatus 120 also has an expansion anchor 125 threadingly engaged with the threaded shaft 124 for anchoring against the rock within the bore hole 18 and means for bearing against the rock at the opening of the bore hole 18.

The bearing means is attached to the second end 138 of the cable 12 and preferably includes a second collar 134 fixedly attached to the second end of the cable 12 having a threaded portion. The bearing means preferably also includes a hex nut 28 which screws onto the threaded portion of the second collar 134 and serves as a mechanism through which the cable 12 is turned. A washer 30 and contact plate 32 are disposed between the hex nut and the rock face.

Preferably, the mining support 120 also has a resin cartridge 16 and means for mixing resin in the resin cartridge 16. The mixing means is preferably a helical mixing strand 128 that wraps about the cable 12. The mixing strand 128 can be attached to the cable 12 by sandwiching a portion of it between the first collar 126 and the cable 12 before the first collar 126 is swedged on. Alternatively, the mixing strand 128 can be swedged to the cable 12 or welded to collar 126 above it. When the mining support 120 is turned, the strand 128 facilitates mixing of the resin.

The mining support 120 can further include a bending restrictor 25 which is disposed about the cable 12 such that at least a portion of the cable 12 is prevented from bending as it is inserted into the bore hole 18. The bending restrictor 25 can be free moving, or swedged to the cable or attached to the second collar 134 by being welded thereto.

The present invention is also a method of supporting rock within a mine. The method includes the first step of drilling a bore hole into the rock. Next, there is the step of placing a first end of a cable into the bore hole. Then, there is the step of turning the cable such that an expansion anchor disposed on the cable expands to anchor the cable within the bore hole. Preferably, there is the step of inserting a resin cartridge having resin into the bore hole before the placing step, and the placing step includes the step of rupturing the resin cartridge. The turning action also tensions the cable.

In the operation of the mining support 120 having a $1\frac{3}{8}$ inch diameter by a 10 foot length is inserted into a bore hole 18 drilled into the rock 11 within a mine. A $1\frac{1}{4}$ of an inch diameter resin cartridge 16 is inserted into the bore hole 18. Next, the first end 122 of the mining support 120 is inserted into the bore hole 18 with the resin cartridge 16. The mining support 120 is 9 feet 10.5 inches long. The cable 12 is a seven-wire stress relieved steel strand cable having a 0.6 inch outer diameter and meets ASTM A416 grade 270 specifications. The expansion anchor 125 is a $\frac{5}{8}$ inch D8 by Frazer and Jones Co.

The first end 122 of the cable 12 is shoved, by hand, into the bore hole 18 until it contacts the resin cartridge 16. Then, a roof bolting machine is attached to the mining support 120 through the hex nut 28. The bending restrictor 25 prevents the cable 12 from bending as it is inserted further into the bore hole 18. The cable 12 is then pushed through the resin cartridge 16, puncturing it. The cable 12 is then turned by torquing the hex nut 28 with the rod bolting machine. This turning action serves three simultaneous purposes. First, the rotation of the hex nut 28 causes the cable 12 to rotate, which in turn causes the threaded shaft 124 to be threaded through the expansion anchor 125, engaging it to the rock 11. Second, as the threaded shaft 124 threads through the expansion anchor, the contact plate 32 is pulled up against the rock face to tension the cable 12. Third, the turning action causes the helical mixing strand 128 to rotate with the cable 12, thus moving through the resin from the ruptured resin cartridge 16, mixing it. The contact plate 32 is steel and is $6\times6$ inches and has a $\frac{1}{2}$ inch thickness. A round steel washer 30 for a $1\frac{1}{4}$ inch bolt is positioned between the hex nut 28 and the contact plate 32.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A mining support for supporting rock within a mine comprising:

a cable;

means for mixing resin, said mixing means positioned about a portion of the cable;

a threaded shaft fixedly attached to a first end of said cable;

an expansion anchor threadingly engaged about said threaded shaft for anchoring in the rock within a bore hole;

means for bearing against the rock at the opening of the bore hole, said bearing means attached to a second end of the cable, said bearing means including a second collar fixedly attached to a second end of the cable having a threaded portion on which a hex nut is threadingly engaged, and a contact plate for bearing against the rock, said hex nut disposed between the second end of the cable and the plate; and a bending restrictor disposed about the cable such that at least a portion of the cable is prevented from bending as it is inserted into the bore hole having resin therein, said bending restrictor disposed between the second collar and the threaded shaft about the cable.

2. A mining support as described in claim 1 including a first collar for fixedly attaching the cable to the threaded shaft, said first collar disposed about a portion of the cable and the threaded shaft.

3. A mining support as described in claim 2 wherein said mixing means includes a helical wire strand that wraps about a portion of the cable.

4. A mining support as described in claim 3 wherein a washer is included between the hex nut and contact plate.

5. A mining support as described in claim 4 wherein the first and second collars are swaged onto the cable.

6. A method of supporting rock within a mine comprising the steps of:

drilling a bore hole into the rock;

inserting a resin cartridge into the bore hole;

placing a first end of a cable into the bore hole so that the first end ruptures the resin cartridge; and turning a hex nut on a second end of the cable such that, simultaneously, an expansion anchor on the first end of the cable expands to anchor the cable within the bore hole, the cable is tensioned and the resin cartridge is mixed.

7. A system for supporting rock within a mine comprising:

a cable;

a threaded shaft fixedly attached to a first end of said cable;

an expansion anchor threadingly engaged about said threaded shaft for anchoring in the rock within a bore hole;

means for bearing against the rock at the opening of the bore hole, said bearing means attached to a second end of the cable, said bearing means including a second collar fixedly attached to a second end of the cable having a threaded portion on which a hex nut is threadingly engaged, and a contact plate for bearing against the rock, said hex nut disposed between the second end of the cable and the plate;

a resin cartridge having resin for bonding the cable to the rock, said cartridge disposed within the bore hole; and a bending restrictor disposed about the cable such that at least a portion of the cable is prevented from bending as it is inserted into the bore hole having resin therein, said bending restrictor disposed between the second collar and the threaded shaft.

8. A mining support as described in claim 7 including a first collar for fixedly attaching the cable to the threaded shaft, said first collar disposed about a portion of the cable and the threaded shaft.

9. A mining support as described in claim 8 wherein the threaded shaft has a cavity for engaging with the cable.

10. A mining support as described in claim 9 including means for mixing resin, said mixing means positioned about a portion of the cable.

11. A mining support as described in claim 10 wherein said mixing means includes a helical wire strand that wraps about a portion of the cable.

12. A mining support as described in claim 11 wherein a washer is disposed between the hex nut and contact plate.

* * * * *